US009006600B2

(12) United States Patent
Leusenkamp et al.

(10) Patent No.: US 9,006,600 B2
(45) Date of Patent: Apr. 14, 2015

(54) HIGH CURRENT VACUUM INTERRUPTER WITH SECTIONAL ELECTRODE AND MULTI HEAT PIPES

(71) Applicant: Eaton Corporation, Cleveland, OH (US)

(72) Inventors: Martin Leusenkamp, Hengelo (NL); Li Yu, Shanghai (CN)

(73) Assignee: Eaton Corporation, Cleveland, OH (US)

( * ) Notice: Subject to any disclaimer, the term of this patent is extended or adjusted under 35 U.S.C. 154(b) by 102 days.

(21) Appl. No.: 13/918,031

(22) Filed: Jun. 14, 2013

(65) Prior Publication Data

US 2014/0367363 A1 Dec. 18, 2014

(51) Int. Cl.

| | |
|---|---|
| ***H01H 33/66*** | (2006.01) |
| ***H01H 9/52*** | (2006.01) |
| ***H01H 1/62*** | (2006.01) |
| *H01H 33/664* | (2006.01) |

(52) U.S. Cl.

CPC ..... *H01H 9/52* (2013.01); *H01H 2009/523* (2013.01); *H01H 2009/526* (2013.01); *H01H 1/62* (2013.01); *H01H 33/66* (2013.01); *H01H 33/6644* (2013.01)

(58) Field of Classification Search

USPC ..... 218/140, 118, 125, 136

See application file for complete search history.

(56) References Cited

U.S. PATENT DOCUMENTS

| | | | | |
|---|---|---|---|---|
| 4,005,297 | A * | 1/1977 | Cleaveland | 218/118 |
| 4,012,707 | A * | 3/1977 | Marek et al. | 337/27 |
| 4,443,672 | A * | 4/1984 | Oeschger | 218/125 |
| 4,650,939 | A * | 3/1987 | Milianowicz | 218/118 |
| 4,743,876 | A | 5/1988 | Milianowicz et al. | |
| 5,646,386 | A | 7/1997 | Yorita et al. | |
| 7,173,208 | B2 | 2/2007 | Harada et al. | |
| 2004/0232113 | A1 * | 11/2004 | Kynast et al. | 218/136 |
| 2006/0162160 | A1 | 7/2006 | Hsu | |
| 2009/0255794 | A1 * | 10/2009 | Kurth et al. | 200/289 |
| 2013/0075368 | A1 * | 3/2013 | Marchand et al. | 218/140 |

FOREIGN PATENT DOCUMENTS

| | | |
|---|---|---|
| DE | 39 41 388 A1 | 6/1991 |
| JP | H06 150784 A | 5/1994 |

OTHER PUBLICATIONS

European Patent Office, "International Search Report and Written Opinion", Sep. 5, 2014, 13 pp.

* cited by examiner

*Primary Examiner* — Truc Nguyen

(74) *Attorney, Agent, or Firm* — Eckert Seamans Cherin & Mellott, LLC; David C. Jenkins

(57) ABSTRACT

An electrode assembly for a circuit breaker is provided. The electrode assembly includes a conductive assembly and a heat transfer assembly. The conductive assembly includes a stem portion and a contact portion. The heat transfer assembly includes a number of elongated bodies, a first heat transfer surface, and a second heat transfer surface. The first heat transfer surface is disposed on the conductive assembly. Each heat transfer assembly body includes a second heat transfer surface. Each heat transfer assembly body is coupled to the conductive assembly with the first heat transfer surface coupled to a number of second heat transfer surfaces.

16 Claims, 7 Drawing Sheets

HIGH CURRENT VACUUM INTERRUPTER WITH SECTIONAL ELECTRODE AND MULTI HEAT PIPES

BACKGROUND OF THE INVENTION

1. Field of the Invention

The disclosed and claimed concept relates to circuit interrupters and, more specifically, to vacuum circuit interrupters, such as, for example, a vacuum circuit interrupter including electrodes enclosing heat transfer assemblies.

2. Background Information

Circuit breakers and other such devices provide protection for electrical systems from electrical fault conditions such as current overloads, short circuits, and low level voltage conditions. In one embodiment, circuit breakers include a spring-powered operating mechanism which opens electrical contacts to interrupt the current through the conductors in an electrical system in response to abnormal conditions. In particular, vacuum circuit interrupters include separable main contacts disposed within an insulated and hermetically sealed vacuum chamber within a housing. The contacts are part of an electrode including a stem and a contact member. Generally, one of the electrodes is fixed relative to the housing. The other electrode is moveable relative to the housing and the other electrode. In a vacuum circuit interrupter, the moveable electrode assembly usually comprises a copper stem of circular cross-section having the contact member at one end enclosed within the vacuum chamber, and a driving mechanism at the other end which is external to the vacuum chamber.

Vacuum interrupters are, in one embodiment, used to interrupt medium voltage alternating current (AC) currents and, also, high voltage AC currents of several thousands of amperes or more. In one embodiment, one vacuum interrupter is provided for each phase of a multi-phase circuit and the vacuum interrupters for the several phases are actuated simultaneously by a common operating mechanism, or separately or independently by separate operating mechanisms. The electrodes can take three positions: closed, opened and grounded.

When the electrodes are in the closed position, the contact members are in electrical communication and electricity flows therethrough. In this configuration, the electrodes become heated, Generally, the amount of heat generated is a function of the cross-sectional area of the electrodes and the amount of current. That is, smaller electrodes and/or higher currents generate more heat. Accordingly, using traditional electrodes, in order to have a circuit breaker rated at a higher current, the electrode must be larger.

Larger electrodes, however, have several disadvantages. For example, larger electrodes are more expensive and require a more robust operating mechanism, which is also more expensive. Further, a larger/more robust operating mechanism requires more energy to operate and is, therefore, more expensive to use as well. There is, therefore, a need for an electrode that is rated at a higher current while having a smaller size and/or volume. There is a further need for such an electrode to be operable with existing circuit breakers.

SUMMARY OF THE INVENTION

These needs, and others, are met by at least one embodiment of the disclosed concept which provides an electrode assembly for a circuit breaker. The electrode assembly includes a conductive assembly and a heat transfer assembly. The conductive assembly includes a stem portion and a contact portion. The heat transfer assembly includes a number of elongated bodies, a first heat transfer surface, and a second heat transfer surface. The first heat transfer surface is disposed on the conductive assembly. Each heat transfer assembly body includes a second heat transfer surface. Each heat transfer assembly body is coupled to the conductive assembly with the first heat transfer surface coupled to a number of second heat transfer surfaces.

The heat transfer assembly allows heat to be drawn from the electrode so that the electrode is cooled.

BRIEF DESCRIPTION OF THE DRAWINGS

A full understanding of the disclosed concept can be gained from the following description of the disclosed embodiments when read in conjunction with the accompanying drawings in which.

DESCRIPTION OF THE PREFERRED EMBODIMENTS

Figure 1:
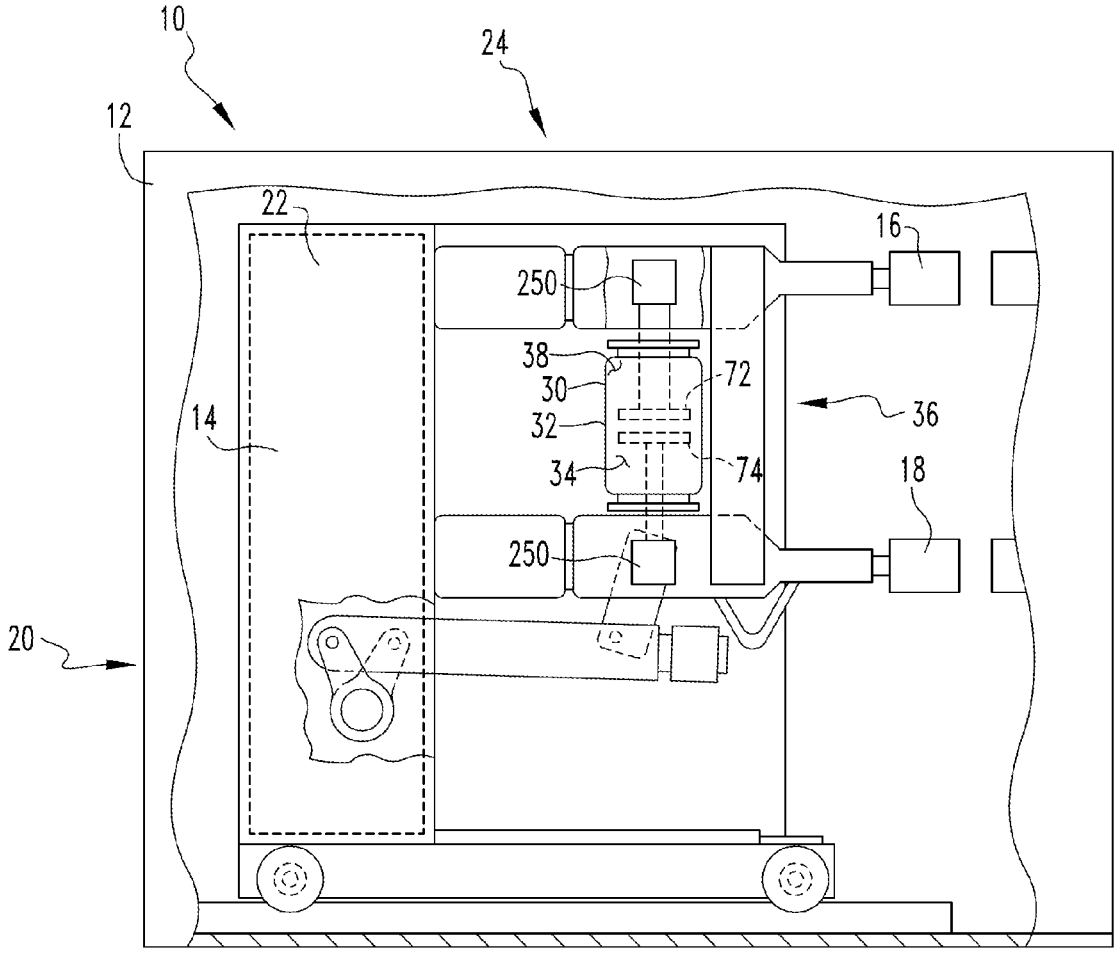
FIG. 1 is a schematic cross-sectional side view of a vacuum circuit breaker.
Figure 2:
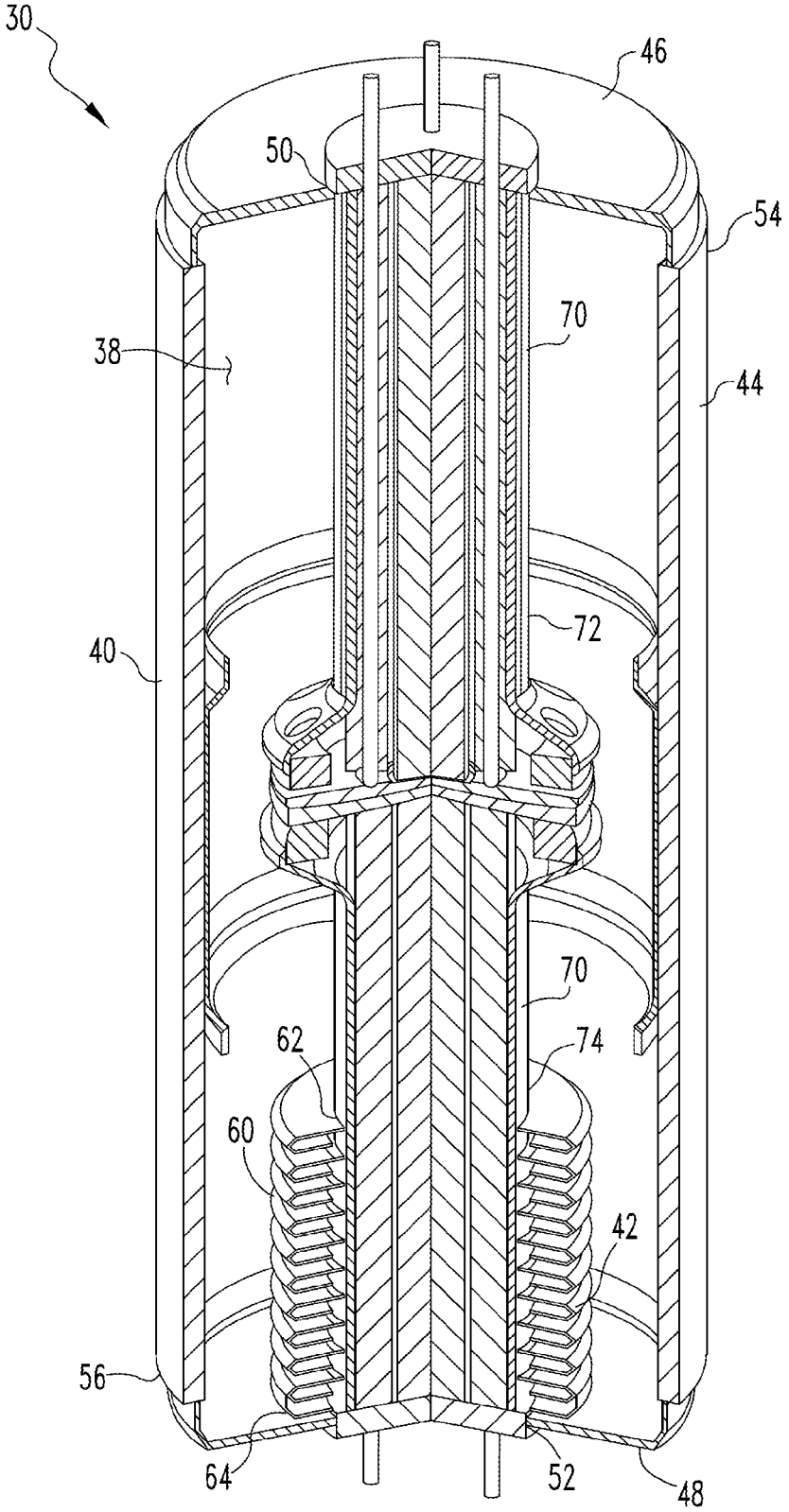
FIG. 2 is a sectional, isometric view of a vacuum interrupter assembly.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, "sealingly coupled, directly coupled or fixed" means that the coupled elements are coupled with a seal so that no substantial amount of fluid passes through the coupling. Elements that are "sealingly coupled, directly coupled or fixed" are able to maintain a vacuum for an extended period of time.

As used herein, the statement that two or more parts or components "engage" one another shall mean that the parts exert a force against one another either directly or through one or more intermediate parts or components.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "associated" means that the elements are part of the same assembly and/or operate together, or, act upon with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit.

As shown in FIG. 1, a circuit breaker 10 includes a number of vacuum interrupt assemblies 30. The circuit breaker 10 preferably includes a housing assembly 12 and a control panel 14, an upper terminal 16, a lower terminal 18, an operating mechanism 20, as well as the aforementioned vacuum interrupt assembly 30. The circuit breaker housing assembly 12 is coupled, directly coupled or fixed to the control panel 14 and the operating mechanism 20. In an exemplary embodiment, the circuit breaker housing assembly 12 partially encloses and supports the control panel 14 and the operating mechanism 20. The control panel 14 is structured to manually actuate the operating mechanism 20. The operating mechanism 20 moves the electrodes 72, 74 (discussed below) between an open and closed configuration. The housing assembly 12 is further coupled, directly coupled or fixed to the upper terminal 16 and the lower terminal 18. That is, in an exemplary embodiment, the circuit breaker housing assembly 12 supports the upper terminal 16 and the lower terminal 18. The circuit breaker 10, in an exemplary embodiment (not shown), includes additional terminals. The upper terminal 16 and the lower terminal 18 are, respectively, coupled, directly coupled or fixed to a line-in (not shown) and a load (not shown). Generally, the circuit breaker 10 has a low voltage portion 22 adjacent to the control panel 14 and a high voltage portion 24 that includes the vacuum interrupt assembly 30.

The vacuum interrupter assembly 30 includes vacuum chamber support housing 32, a vacuum chamber 34, and a pair of separable electrodes 36. That is, the separable electrodes 36, in an exemplary embodiment, includes two substantially similar electrode assemblies 70 (FIG. 3), discussed below. One electrode assembly 70 is a stationary, first electrode assembly 72 and the other electrode assembly 70 is a moveable, second electrode assembly 74. Generally, the vacuum chamber support housing 32 is coupled, directly coupled or fixed to the vacuum chamber 34. In an exemplary embodiment, the vacuum chamber support housing 32 substantially encloses the vacuum chamber 34.

The vacuum chamber 34 includes a sidewall 40 and a bellows 42. The vacuum chamber sidewall 40, in an exemplary embodiment, includes a hollow, generally cylindrical member 44, a first generally planar torus member 46, and a second generally planar torus member 48. That is, the first and second torus members are generally circular with a central opening, hereinafter the first opening 50 and the second opening 52, respectively. The vacuum chamber sidewall cylindrical member 44 includes a first end 54 and a second end 56. The first torus member 46 is sealingly coupled, directly coupled or fixed to the vacuum chamber sidewall first end 54. The second torus member 48 is sealingly coupled, directly coupled or fixed to the vacuum chamber sidewall second end 56. Thus, the vacuum chamber sidewall 40 defines a substantially enclosed space 38.

The bellows 42 include an extendable body 60 having a first end 62 and a second end 64. In an exemplary embodiment, the bellows body 60 is toroidal. The bellows body first end 62 is sealingly coupled, directly coupled or fixed to the second torus member 48 and extends about the second opening 52.

The stationary electrode assembly 72 and the moveable electrode assembly 74 are substantially disposed within the vacuum chamber enclosed space 38. That is, the stationary electrode assembly 72 and the moveable electrode assembly 74 each include an elongated stem portion 80, and a contact portion 82. A stationary electrode assembly stem portion proximal end 88 partially extends through the vacuum chamber sidewall 40 at the first opening 50. The vacuum chamber sidewall 40 is sealingly coupled, directly coupled or fixed to the stationary electrode assembly stem portion proximal end 88. A moveable electrode assembly stem portion proximal end 88 extends through the bellows 42. The bellows second end 64 is sealingly coupled, directly coupled or fixed to the moveable electrode assembly stem portion proximal end 88. In this configuration, the separable electrodes 36 are substantially sealed within the vacuum chamber enclosed space 38. The moveable electrode assembly stern portion proximal end 88 is further coupled, directly coupled or fixed to, and in electrical communication with, the upper terminal 16. The moveable electrode assembly stem portion proximal end 88 is further coupled, directly coupled or fixed to, and in electrical communication with, the lower terminal 18.

Details about the operating mechanism 20 for moving the electrode assemblies 72 and 74 are described in detail in U.S. Pat. No. 4,743,876. Generally, the operating mechanism 20 moves the separable electrodes 36 between an open first position, wherein the moveable electrode assembly 74 is spaced from, and not in electrical communication with, the stationary electrode assembly 72, and, a closed second position, wherein the moveable electrode assembly 74 is coupled to, or directly coupled to, and in electrical communication with, the stationary electrode assembly 72. The stationary electrode assembly 72 and the moveable electrode assembly 74 are substantially similar.

Figure 3:
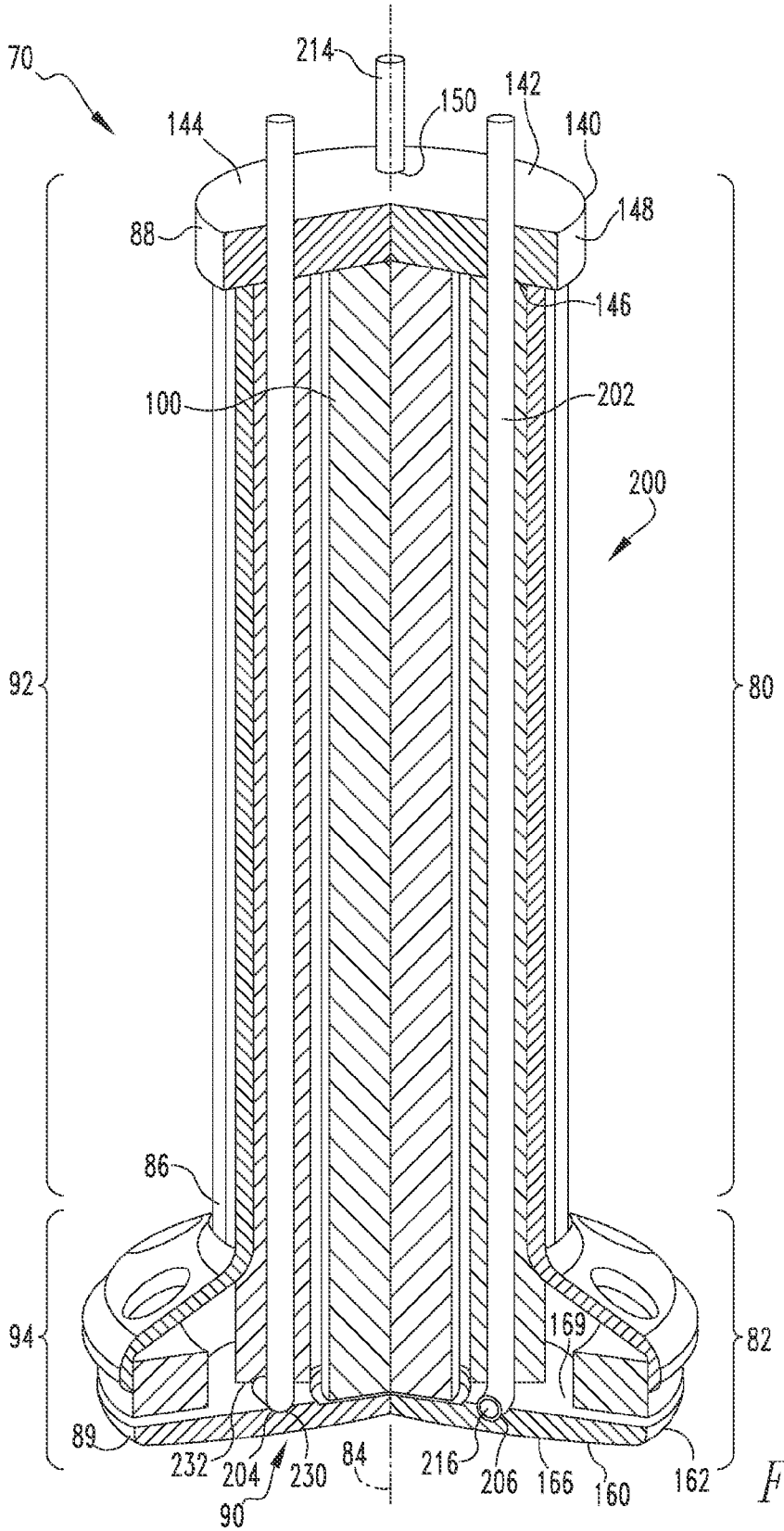
FIG. 3 is a sectional, isometric view of an electrode assembly.

As shown in FIG. 3, an electrode assembly 70 includes a stem portion 80 and a contact portion 82. The electrode assembly stem portion 80 is elongated and includes a longitudinal axis 84 as well as a distal end 86 and a proximal end 88. As used herein, the electrode assembly stem portion distal end 86 is the end disposed within the vacuum chamber 34 and the electrode assembly stem portion proximal end 88 is the end extending through the vacuum chamber 34. The electrode assembly contact portion 82 is, in an exemplary embodiment, is a generally planar member 89. The plane of the electrode assembly contact portion 82 extends generally perpendicular to the electrode assembly stem portion longitudinal axis 84. The other elements of the electrode assembly 70, described below, are part of either, or both, the electrode assembly stem portion 80 and/or the electrode assembly contact portion 82. It is understood that the terms "stem portion" and "contact portion" may be used as adjectives to identify the location, or approximate location, and/or the shape of portions of the other elements of the electrode assembly 70. For example, it is understood that if an element is identified as a "stem portion" it is elongated and if an element is identified as a "contact portion" it is generally planar or is disposed in a plane.

The electrode assembly 70 further includes a conductive assembly 90 and a heat transfer assembly 200. The conductive assembly 90 includes a stem portion 92 and a contact portion 94. As discussed below, a first heat transfer surface 204 is incorporated into the conductive assembly 90 as well. The conductive assembly 90 includes a number of elongated coil members 100, an end cap 140, and a contact member 160. Further, the coil members 100 each include a stem portion 104 and a contact portion 106. The conductive assembly stem portion 92 includes the coil member stem portion 104 and the end cap 140. The conductive assembly contact portion 94 includes the coil member contact portion 106 and the contact member 160.

Figure 4:
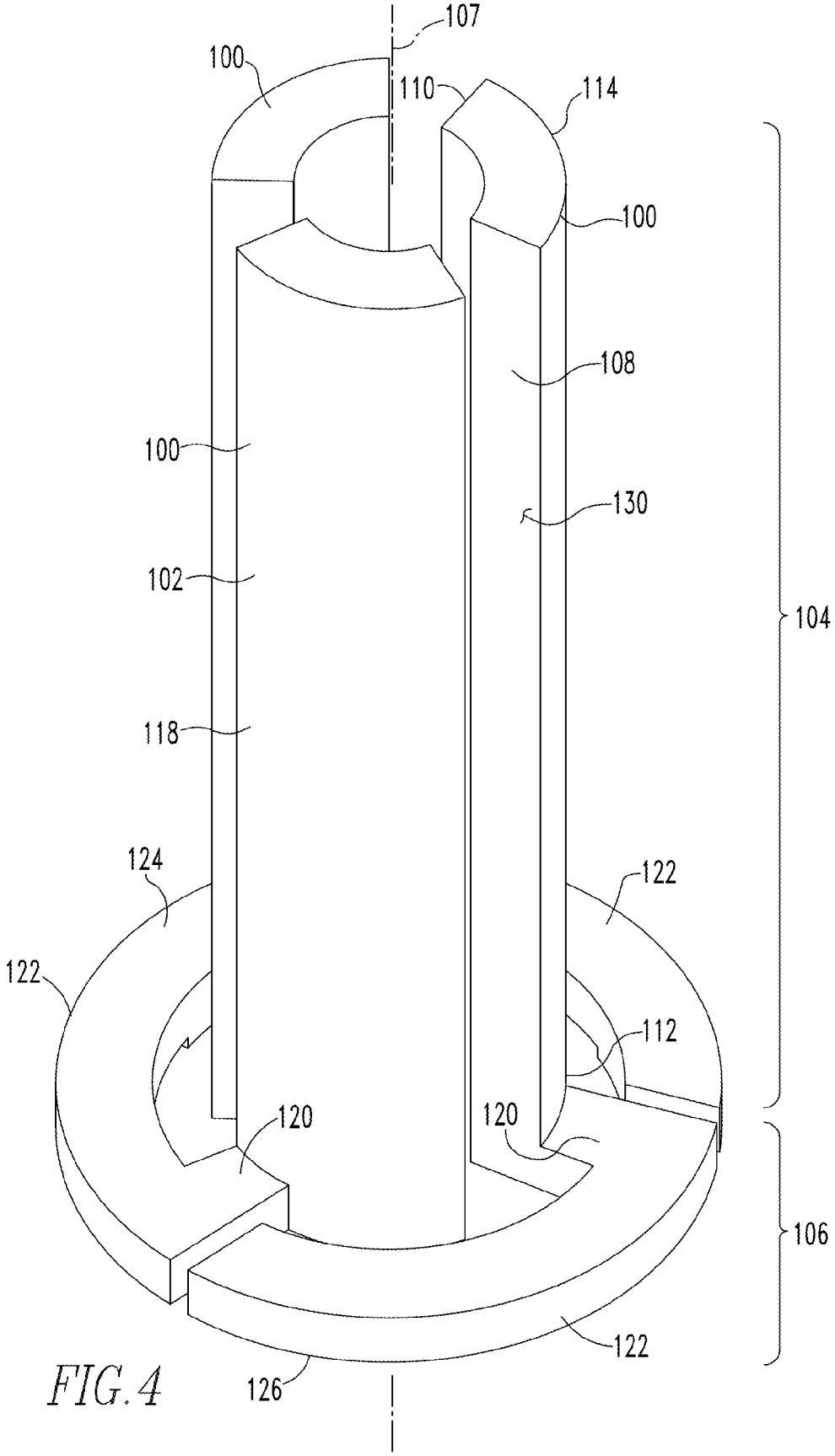
FIG. 4 is an isometric view of a number of coil members.
Figure 5A:
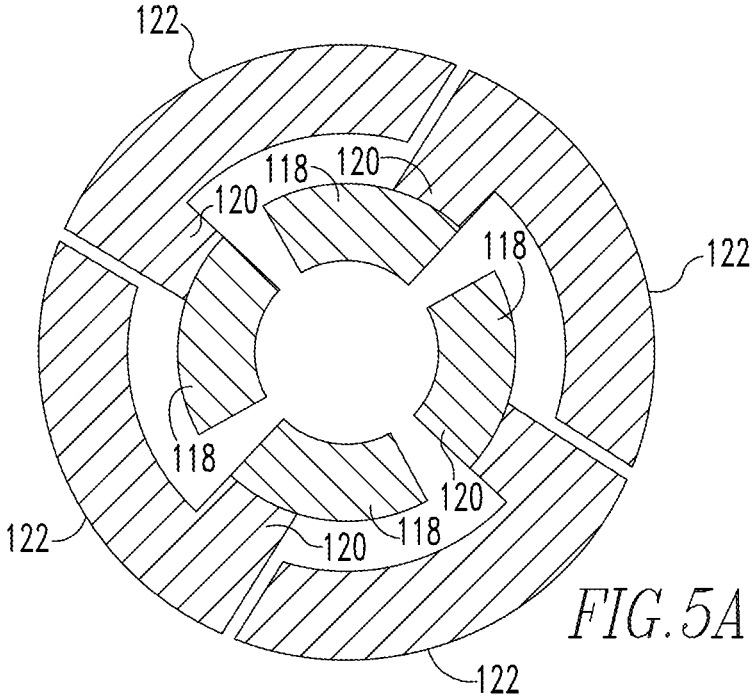
FIG. 5A is a bottom view of one embodiment of a number of coil members.
Figure 5B:
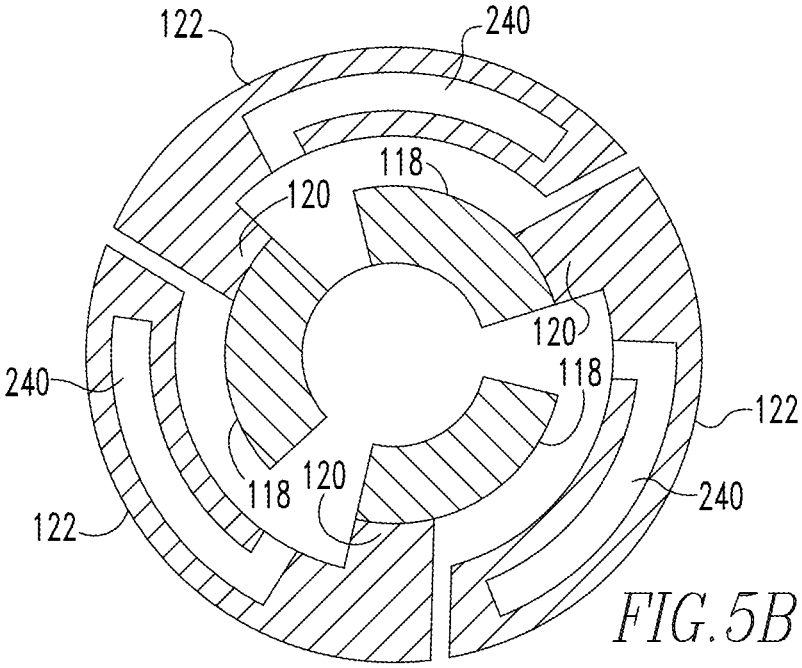
FIG. 5B is a bottom view of another embodiment of a number of coil members.

The number of coil members 100 are conductive members assembled so as to form a generally circular, or cylindrical, assembly, as shown in FIG. 4. Thus, each coil member 100 extends over an arc. The number of coil members 100 determines the size and the curvature of each coil member 100. For example, if there are four coil members 100, as shown in FIG. 5A, each coil member 100 extends over an arc of about ninety degrees whereas in an embodiment with three coil members 100, as shown in FIG. 5B, each coil member extends over an arc of about one-hundred and twenty degrees. Thus, generally, the arc of each coil member 100 is 360/N wherein N is the number of coil members 100.

The coil members 100 are, in an exemplary embodiment, substantially similar and, as such only one will be described. A coil member 100 includes a body 102 having a stern portion 104 and a contact portion 106. The coil member stem portion 104 is elongated and has a generally arcuate cross-section. Thus, the coil member stem portion 104 includes a longitudinal axis 107, a first lateral side 108 and a second lateral side 110. As noted above, the arc of the coil member stem portion 104 is related to the number of coil members 100. Further, as described below, in an exemplary embodiment, there is a gap 130 between adjacent coil members 100. Thus, in an exemplary embodiment, the arc of the coil member stem portion 104 is slightly less than 360/N wherein N is the number of coil members 100. Further, coil member stem portion 104 includes a first end 112 and a second end 114. As shown in FIG. 3, the coil member stem portion first end 112 is disposed at the electrode assembly stem portion distal end 86, and, the coil member stem portion second end 114 is disposed at the electrode assembly stern portion proximal end 88.

The coil member contact portion 106 includes an inner arcuate portion 118, a radial portion 120 and a circumferential portion 122. The coil member contact portion inner arcuate portion 118 (hereinafter, "coil member arcuate portion 118") is, in an exemplary embodiment, unitary with the coil member stem portion 104 and is, in an exemplary embodiment, an extension of the coil member stem portion second end 114. The coil member contact portion radial portion 120 (hereinafter "coil member radial portion 120") extends radially outwardly from the coil member arcuate portion 118 and generally perpendicular to the coil member stem portion longitudinal axis 107. That is, the coil member radial portion 120 is coupled, directly coupled, fixed, or unitary with, the coil member arcuate portion 118. The coil member radial portion 120, in an exemplary embodiment, extends over an arc that is substantially smaller than the arc of the coil member stem portion 104.

The coil member contact portion circumferential portion 122 (hereinafter "coil member circumferential portion 122") is a generally planar, arcuate member. The coil member circumferential portion 122 is coupled, directly coupled, fixed, or unitary with, the coil member radial portion 120. The coil member circumferential portion 122 is spaced from the coil member stem portion 104. Similar to the coil member stem portion 104, the arc of the coil member circumferential portion 122 is related to the number of coil members 100. Further, as described below, in an exemplary embodiment, there is a gap 130 between adjacent coil members 100. Thus, in an exemplary embodiment, the arc of the coil member circumferential portion 122 is slightly less than 360/N wherein N is the number of coil members 100. The coil member circumferential portion 122 is disposed in a plane that is generally perpendicular to the coil member stem portion longitudinal axis 107.

The coil member contact portion 106 includes an outer, first surface 124 and an inner, second surface 126. In reference to the coil member contact portion first and second surfaces 124, 126, "outer" means away from the point where two electrode assemblies 70 engage each other, and, "inner" means toward the point where two electrode assemblies 70 engage each other. The coil member contact portion first surface 124 includes the outer surface of the coil member radial portion 120, and the coil member circumferential portion 122. The coil member contact portion second surface 126 includes the inner surface of the coil member arcuate portion 118, the coil member radial portion 120, and the coil member circumferential portion 122.

The end cap 140 is a conductive member and, in an exemplary embodiment, includes a generally planar disk-shaped body 142 having an outer, first surface 144, an inner, second surface 146 and a radial surface 148. The end cap 140 further includes a number of passages 150 extending through the end cap body 142. The end cap radial surface 148 is sealingly coupled, directly coupled or fixed to either the vacuum chamber first torus member 46 or the bellows body second end 64 depending upon the location of the electrode assembly 70.

Figure 6:
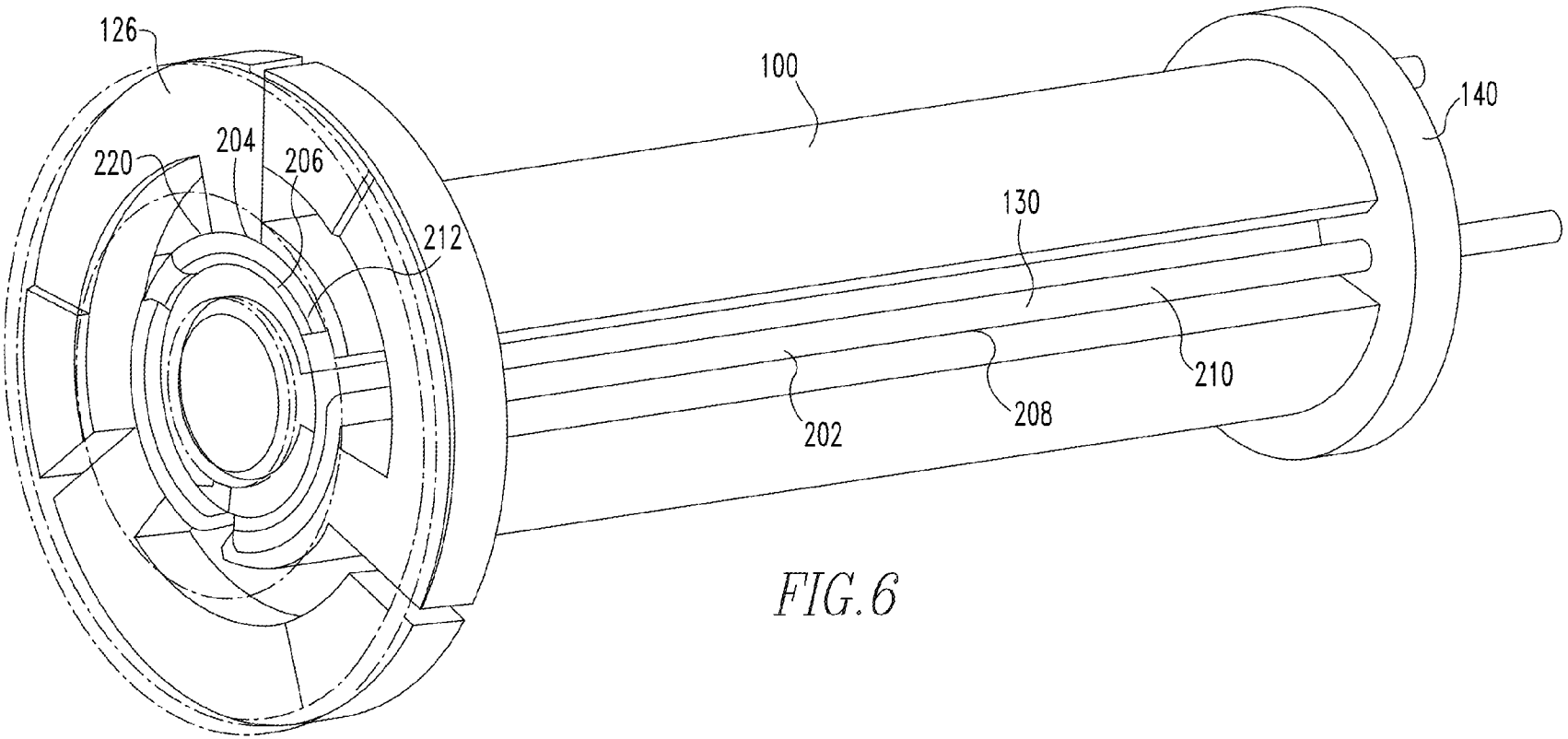
FIG. 6 is an isometric view of an electrode assembly.
Figure 7:
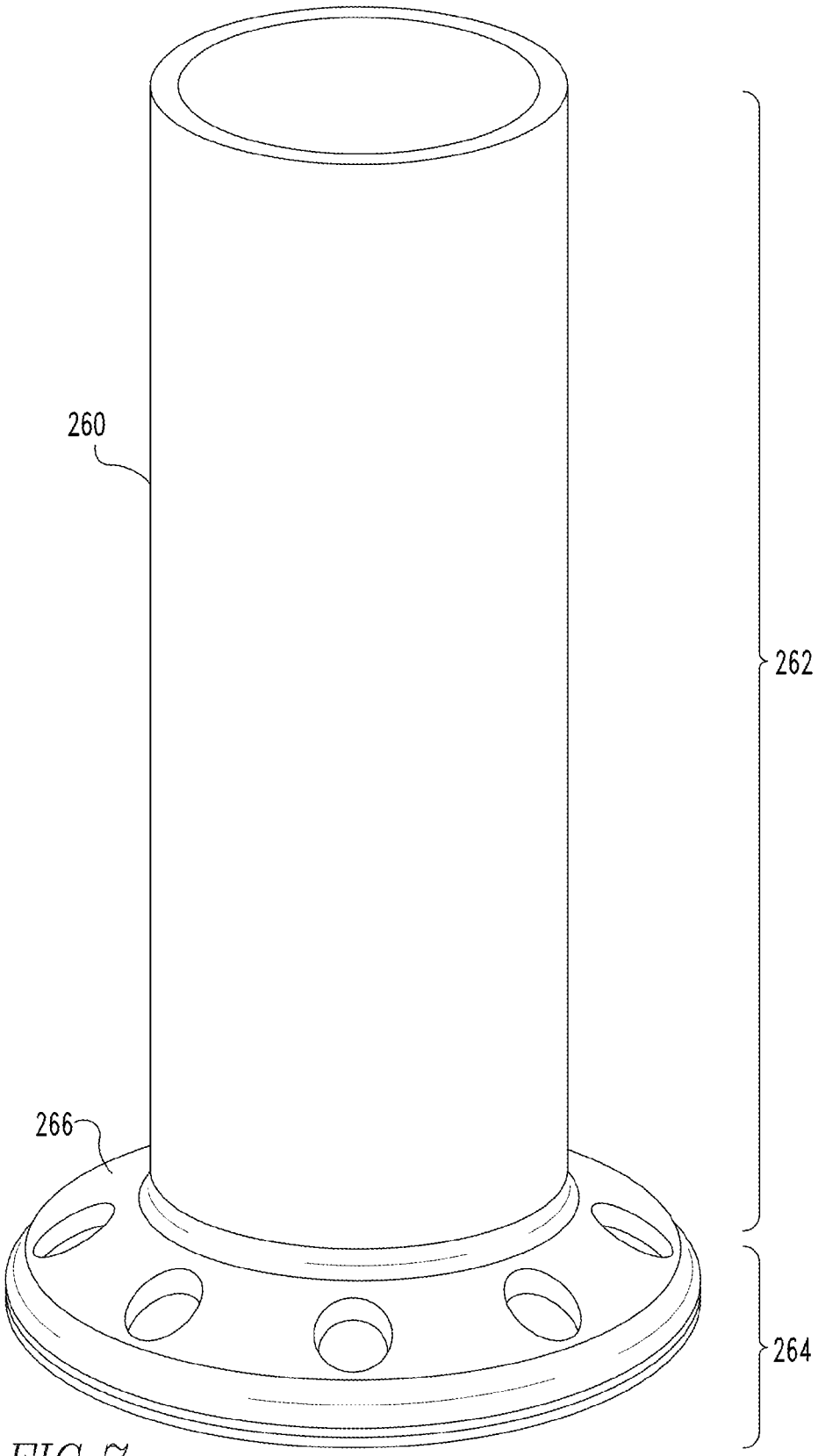
FIG. 7 is an isometric view of a support member.

As shown in FIG. 6, the number of coil members 100 are coupled, directly coupled, fixed, or unitary with end cap 140. In an exemplary embodiment, the coil members 100 extend from the end cap second surface 146. The number of coil members 100 are disposed about a common longitudinal axis which, in an exemplary embodiment, is the electrode assembly stem portion longitudinal axis 84. As noted above, the arc of the coil member stem portion 104 is slightly less than 360/N wherein N is the number of coil members 100. Thus, when the coil members 100 are evenly spaced about a common longitudinal axis, there is a gap 130 between each pair of adjacent coil member stern portion lateral sides 108, 110. That is, a first coil member stem portion first lateral side 108 is spaced from a second, adjacent coil member stem portion second lateral side 110. Thus, there are a number of longitudinal gaps 130 extending over the conductive assembly stem portion 92.

The conductive assembly contact portion 94 includes the coil member contact portion 106, described above, and the contact member 160. The contact member 160 is a conductive member and, in an exemplary embodiment, a generally planar disk-shaped body 162. The contact member body 162 includes an outer, first surface 164 and an inner, second surface 166. As shown in FIG. 1, when two electrode assemblies 70 are disposed in opposition to each other, such as the stationary electrode assembly 72 and the moveable electrode assembly 74, the two contact member second surfaces 166 engage each other, and are in electrical communication, when the contact assemblies 70 are in a closed, second position. The contact member first surface 164 is coupled, directly coupled, or fixed to, and in electrical communication with, each coil member 100. In an exemplary embodiment, as shown in FIG. 3, each coil member contact portion 106, i.e. each coil member radial portion 120 and each coil member circumferential portion second surface 126 is coupled, directly coupled, or fixed to, and in electrical communication with, the contact member first surface 164. Further, in this configuration, the conductive assembly 90 allows for high efficient current density. In an exemplary embodiment, the conductive assembly 90 has a diameter of about 20 mm or larger.

The heat transfer assembly 200 includes a number of elongated bodies 202, a first heat transfer surface 204, and a second heat transfer surface 206. In an exemplary embodiment, the elongated bodies 202 are heat pipes 208. As used herein, a "heat pipe" is a hollow tubular member and, in an exemplary embodiment, a sealed member having a vacuum and a wire mesh wick (not shown) within the tubular member. In an exemplary embodiment, the heat transfer bodies 202 have a generally circular cross-section. The heat transfer bodies 202 each include a stem portion 210 and a contact portion 212. The heat transfer assembly body stem portion 210 includes a first end 214 (hereinafter "heat transfer assembly body first end 214"), and, the heat transfer assembly body contact portion 212 includes a second end 216 (hereinafter "heat transfer assembly body second end 216"). In an exemplary embodiment, the heat transfer assembly body contact portion 212 is disposed in a plane and that plane is generally perpendicular to the longitudinal axis of the heat transfer assembly body stem portion 210. Further, the heat transfer assembly body contact portion 212 is, in an exemplary embodiment, generally arcuate and has a curvature corresponding to the coil member circumferential portion 122.

The first heat transfer surface 204 is disposed on the conductive assembly 90. That is, the first heat transfer surface 204 is also part of the conductive assembly 90. In an exemplary embodiment, the first heat transfer surface 204 is the surface of a heat transfer passage 220 extending through the conductive assembly contact portion 94. For example, as shown in FIG. 3 the contact member body outer, first surface 164 includes a channel 230. The contact member channel 230 may be formed in intermittent segments. Further, the coil member contact portion second surface 126 includes a channel 232. In an exemplary embodiment, the coil member channel 232 is disposed on the inner surface of the coil member arcuate portion 118. The contact member channel 230 and each the coil member channel 232 are positioned so that, when the coil members 100 are coupled to the contact member 160, the contact member channel 230 and each the coil member channel 232 form the heat transfer passage 220. That is, each coil member contact portion second surface 126 is coupled to the contact member first surface 164 with each coil member contact portion second surface channel 232 aligned with the contact member first surface channel 230 whereby each coil member contact portion second surface channel 232 and the contact member first surface channel 230 form the heat transfer passage 220.

In this configuration, the first heat transfer surface 204 is disposed substantially over the surface of the heat transfer passage 220. Further, the heat transfer assembly body contact portion 212 is sized and shaped to correspond to the heat transfer passage 220. Thus, when the heat transfer assembly body contact portion 212 has a generally circular cross-section, the contact member first surface channel 230 and each coil member contact portion second surface channel 232 have a generally semi-circular cross-sectional shape. When assembled, the heat transfer assembly body contact portion 212 is disposed in the heat transfer passage 220. In this configuration, the second heat transfer surface 206 is disposed over the surface of each said heat transfer assembly body contact portion 212.

In an alternate embodiment, shown schematically in FIG. 5B, the conductive assembly 90 defines a generally semi-circular heat transfer groove 240. The conductive assembly heat transfer groove 240 has a greater radius than in the prior embodiment an is disposed on one of the contact member body outer, first surface 164 or inner surface of the coil member circumferential portion 122 (as shown). In an exemplary embodiment, not shown, wherein the heat transfer groove 240 is disposed between the coil member arcuate portion 118 and the coil member circumferential portion 122, the heat transfer groove 240 is semi-circular and corresponds to the generally circular cross-sectional shape of a heat transfer body contact portion 212. That is, about half of each heat transfer body contact portion 212 is disposed in the heat transfer groove 240.

In another exemplary embodiment, as shown in FIG. 5B, the heat transfer groove 240 is about as, or slightly more, deep as the diameter of the heat transfer body contact portion 212.

As noted above, each of the stationary electrode assembly 72 and the moveable electrode assembly 74 are electrode assemblies 70 as described above. The stationary electrode assembly 72 and the moveable electrode assembly 74 are disposed in the vacuum chamber 34 and in opposition to each other. That is, each of the stationary electrode assembly's 72 and the moveable electrode assembly's 74 contact member second surfaces 166 face each other. As further described above, the stationary electrode assembly 72 and the moveable electrode assembly 74 move between an open first position, wherein the moveable electrode assembly 74 is spaced from, and not in electrical communication with, the stationary electrode assembly 72, and, a closed second position, wherein the moveable electrode assembly 74 is coupled to, or directly coupled to, and in electrical communication with, the stationary electrode assembly 72.

In an exemplary embodiment, the heat transfer assembly 200 includes a heat sink 250. That is, as shown schematically in FIG. 1, each heat transfer assembly body first end 214 extends through the associated end cap 140 and outside of the vacuum chamber 34. In an exemplary embodiment, each heat transfer assembly body first end 214 is further coupled to, directly coupled to, fixed to, or unitary with a heat sink 250 (shown schematically). The heat sink 250 associated with the moveable electrode assembly 74 is, in an exemplary embodiment, coupled to, directly coupled to, fixed to, a movable element of the operating mechanism 20 and moves with the moveable electrode assembly 74 when the moveable electrode assembly 74 moves between the first and second positions.

Further, in an exemplary embodiment, the conductive assembly 90 includes a support member 260, as shown in FIG. 8. The support member 260 is structured to enclose the coil members 100. Thus, in an exemplary embodiment, the support member 260 is a tubular shell including a stem portion 262 and a contact portion 264. The support member stem portion 262 has a radius that corresponds to the radius of the coil members 100, when assembled. The support member contact portion 264 has a radius that corresponds to the contact member 160. There is a tapered portion 266 between the support member stem portion 262 and the support member contact portion 264. In an exemplary embodiment, the support member 260 is stainless steel. The support member 260 is structured to refine the electrical field of the electrode assembly 70. That is, the support member 260 is a generally cylindrical volume, which, when exposed to a high voltage creates an electrical field that is generally uniform around the surface of the generally cylindrical support member 260.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of disclosed concept which is to be given the full breadth of the claims appended and any and all equivalents thereof.

What is claimed is:

1. An electrode assembly for a circuit breaker comprising:
a conductive assembly including a stem portion and a contact portion;
a heat transfer assembly including a number of elongated bodies, a first heat transfer surface, and a second heat transfer surface;
said first heat transfer surface disposed on said conductive assembly;
said second heat transfer surface disposed on a number of said heat transfer assembly bodies;
each said heat transfer assembly body coupled to said conductive assembly with said first heat transfer surface coupled to said second heat transfer surface;
each said heat transfer assembly body including a stem portion and a contact portion;
wherein each said heat transfer assembly body contact portion has a generally circular cross-section;
said conductive assembly defines a generally circular heat transfer passage;
each said heat transfer assembly body contact portion corresponding to said heat transfer passage;
wherein said first heat transfer surface is disposed substantially over the surface of said heat transfer passage; and
wherein said second heat transfer surface is disposed over the surface of each said heat transfer assembly body contact portion.

2. An electrode assembly for a circuit breaker comprising:
a conductive assembly including a stem portion and a contact portion;
a heat transfer assembly including a number of elongated bodies, a first heat transfer surface, and a second heat transfer surface;
said first heat transfer surface disposed on said conductive assembly;
said second heat transfer surface disposed on a number of said heat transfer assembly bodies;
each said heat transfer assembly body coupled to said conductive assembly with said first heat transfer surface coupled to said second heat transfer surface;
each said heat transfer assembly body including a stem portion and a contact portion;
wherein each said heat transfer assembly body contact portion has a generally circular cross-section;
said conductive assembly defines a generally semi-circular heat transfer groove;
each said heat transfer assembly body contact portion corresponding to said heat transfer groove;
wherein said first heat transfer surface is disposed over the surface of said heat transfer groove; and
wherein said second heat transfer surface is disposed over about 180 degrees of the surface of each said heat transfer assembly body contact portion.

3. An electrode assembly for a circuit breaker comprising:
a conductive assembly including a stem portion and a contact portion;
a heat transfer assembly including a number of elongated bodies, a first heat transfer surface, and a second heat transfer surface;
said first heat transfer surface disposed on said conductive assembly;
said second heat transfer surface disposed on a number of said heat transfer assembly bodies;
each said heat transfer assembly body coupled to said conductive assembly with said first heat transfer surface coupled to said second heat transfer surface;
said conductive assembly contact portion includes a generally planar contact member and a number of coil member contact portions;
each said contact member including a first surface and a second surface;
each said contact member first surface defining a channel;
each said coil member contact portions including a first surface and a second surface;
each said coil member contact portion second surface defining a channel;
each said coil member contact portion second surface coupled to said contact member first surface with each said coil member contact portion second surface channel aligned with said contact member first surface channel whereby each said coil member contact portion second surface channel and said contact member first surface channel form a heat transfer passage;
each said heat transfer assembly body including a stem portion and a contact portion;
each said heat transfer assembly body contact portion corresponding to said heat transfer passage; and
each said heat transfer assembly body contact portion disposed in said heat transfer passage.

4. The electrode assembly of claim 3 wherein:

said conductive assembly includes a number of coil members;

each coil member including a stem portion and said coil member contact portion;

each coil member contact portion including a radial portion and a circumferential portion;

each said coil member stem portion having a first end, a second end, and a longitudinal axis; and each said coil member radial portion and each said coil member circumferential portion disposed at an associated coil member stem portion first end and disposed in a plane that is generally perpendicular to said coil member stem portion longitudinal axis.

5. The electrode assembly of claim 4 wherein:

each coil member stem portion has an arcuate cross-sectional shape including a first lateral side and a second lateral side;

wherein said coil members are disposed about a common longitudinal axis and wherein each coil member stem portion lateral side is spaced from an adjacent coil member stem portion lateral side whereby there are a number of longitudinal gaps between said coil members; and wherein each said heat transfer assembly body stem portion is disposed in a longitudinal gaps between said coil members.

6. The electrode assembly of claim 4 wherein:

said conductive assembly stem portion includes an end cap;

said end cap coupled to each coil member second end;

each said each said heat transfer assembly body stem portion has a first end and a second end;

each said heat transfer assembly body stem portion first end disposed adjacent a coil member stem portion first end; and each said heat transfer assembly body stem portion second end extending through said end cap.

7. A vacuum interrupter assembly comprising:

a vacuum chamber including a sidewall and a bellows;

said vacuum chamber sidewall defining an enclosed space including a first opening and a second opening;

a bellows including a body with a first end and a second end;

said bellows body first end sealingly coupled to said vacuum chamber sidewall about said second opening;

a stationary, first electrode assembly including a stem portion and a contact portion;

said first electrode assembly stem portion sealingly coupled to said vacuum chamber sidewall at said sidewall first opening;

a movable, second electrode assembly including a stem portion and a contact portion;

said second electrode assembly stem portion sealingly coupled to said bellows second end;

at least one of said first and second electrode assemblies including:

a conductive assembly including a stem portion and a contact portion;

a heat transfer assembly including a number of elongated bodies, a first heat transfer surface, and a second heat transfer surface;

said first heat transfer surface disposed on said conductive assembly;

said second heat transfer surface disposed on a number of said heat transfer assembly bodies;

each said heat transfer assembly body coupled to said conductive assembly with said first heat transfer surface coupled to said second heat transfer surface;

each said heat transfer assembly body including a stem portion and a contact portion;

wherein each said heat transfer assembly body contact portion has a generally circular cross-section;

said conductive assembly defines a generally circular heat transfer passage;

each said heat transfer assembly body contact portion corresponding to said heat transfer passage;

wherein said first heat transfer surface is disposed substantially over the surface of said heat transfer passage; and wherein said second heat transfer surface is disposed over the surface of each said heat transfer assembly body contact portion.

8. A vacuum interrupter assembly comprising:

a vacuum chamber including a sidewall and a bellows;

said vacuum chamber sidewall defining an enclosed space including a first opening and a second opening;

a bellows including a body with a first end and a second end;

said bellows body first end sealingly coupled to said vacuum chamber sidewall about said second opening;

a stationary, first electrode assembly including a stem portion and a contact portion;

said first electrode assembly stem portion sealingly coupled to said vacuum chamber sidewall at said sidewall first opening;

a movable, second electrode assembly including a stem portion and a contact portion;

said second electrode assembly stem portion sealingly coupled to said bellows second end;

at least one of said first and second electrode assemblies including:

a conductive assembly including a stem portion and a contact portion;

a heat transfer assembly including a number of elongated bodies, a first heat transfer surface, and a second heat transfer surface;

said first heat transfer surface disposed on said conductive assembly;

said second heat transfer surface disposed on a number of said heat transfer assembly bodies;

each said heat transfer assembly body coupled to said conductive assembly with said first heat transfer surface coupled to said second heat transfer surface;

each said heat transfer assembly body including a stem portion and a contact portion;

wherein each said heat transfer assembly body contact portion has a generally circular cross-section;

said conductive assembly defines a generally semi-circular heat transfer groove;

each said heat transfer assembly body contact portion corresponding to said heat transfer groove;

wherein said first heat transfer surface is disposed over the surface of said heat transfer groove; and wherein said second heat transfer surface is disposed over about 180 degrees of the surface of each said heat transfer assembly body contact portion.

9. A vacuum interrupter assembly comprising:

a vacuum chamber including a sidewall and a bellows;

said vacuum chamber sidewall defining an enclosed space including a first opening and a second opening;

a bellows including a body with a first end and a second end;

said bellows body first end sealingly coupled to said vacuum chamber sidewall about said second opening;

a stationary, first electrode assembly including a stem portion and a contact portion;

said first electrode assembly stem portion sealingly coupled to said vacuum chamber sidewall at said sidewall first opening;

a movable, second electrode assembly including a stem portion and a contact portion;

said second electrode assembly stem portion sealingly coupled to said bellows second end;

at least one of said first and second electrode assemblies including:

a conductive assembly including a stem portion and a contact portion;

a heat transfer assembly including a number of elongated bodies, a first heat transfer surface, and a second heat transfer surface;

said first heat transfer surface disposed on said conductive assembly;

said second heat transfer surface disposed on a number of said heat transfer assembly bodies;

each said heat transfer assembly body coupled to said conductive assembly with said first heat transfer surface coupled to said second heat transfer surface;

said conductive assembly contact portion includes a generally planar contact member and a number of coil member contact portions;

each said contact member including a first surface and a second surface;

each said contact member first surface defining a channel;

each said coil member contact portions including a first surface and a second surface;

each said coil member contact portion second surface defining a channel;

each said coil member contact portion second surface coupled to said contact member first surface with each said coil member contact portion second surface channel aligned with said contact member first surface channel whereby each said coil member contact portion second surface channel and said contact member first surface channel form a heat transfer passage;

each said heat transfer assembly body including a stem portion and a contact portion;

each said heat transfer assembly body contact portion corresponding to said heat transfer passage; and each said heat transfer assembly body contact portion disposed in said heat transfer passage.

10. The vacuum interrupt assembly of claim 9 wherein:

said conductive assembly includes a number of coil members;

each coil member including a stem portion and said coil member contact portion;

each coil member contact portion including a radial portion and a circumferential portion;

each said coil member stern portion having a first end, a second end, and a longitudinal axis; and each said coil member radial portion and each said coil member circumferential portion disposed at an associated coil member stem portion first end and disposed in a plane that is generally perpendicular to said coil member stem portion longitudinal axis.

11. The vacuum interrupt assembly of claim 10 wherein:

each coil member stem portion has an arcuate cross-sectional shape including a first lateral side and a second lateral side;

wherein said coil members are disposed about a common longitudinal axis and wherein each coil member stem portion lateral side is spaced from an adjacent coil member stem portion lateral side whereby there are a number of longitudinal gaps between said coil members; and wherein each said heat transfer assembly body stein portion is disposed in a longitudinal gaps between said coil members.

12. The vacuum interrupt assembly of claim 10 wherein:

said conductive assembly stem portion includes an end cap;

said end cap coupled to each coil member second end;

each said heat transfer assembly body stem portion has a first end and a second end;

each said heat transfer assembly body stem portion first end disposed adjacent a coil member stem portion first end; and each said heat transfer assembly body stem portion second end extending through said end cap.

13. The vacuum interrupt assembly of claim 9 wherein:

said heat transfer assembly further includes a heat sink; and each said heat transfer assembly body coupled to said heat sink.

14. The vacuum interrupt assembly of claim 13 wherein said heat sink is disposed outside of said vacuum chamber.

15. A vacuum interrupter assembly comprising:

a vacuum chamber including a sidewall and a bellows;

said vacuum chamber sidewall defining an enclosed space including a first opening and a second opening; a bellows including a body with a first end and a second end;

said bellows body first end sealingly coupled to said vacuum chamber sidewall about said second opening;

a stationary, first electrode assembly including a stem portion and a contact portion;

said first electrode assembly stem portion sealingly coupled to said vacuum chamber sidewall at said sidewall first opening;

a movable, second electrode assembly including a stem portion and a contact portion;

said second electrode assembly stem portion sealingly coupled to said bellows second end;

at least one of said first and second electrode assemblies including:

a conductive assembly including a stem portion and a contact portion;

a heat transfer assembly including a number of elongated bodies, a first heat transfer surface, and a second heat transfer surface;

said first heat transfer surface disposed on said conductive assembly;

each said heat transfer assembly body including a second heat transfer surface; and each said heat transfer assembly body coupled to said conductive assembly with said first heat transfer surface coupled to a number of second heat transfer surfaces;

said first electrode assembly includes:

a conductive assembly including a stem portion and a contact portion;

a heat transfer assembly including a number of elongated bodies, a first heat transfer surface, and a second heat transfer surface;

said first heat transfer surface disposed on said conductive assembly;

each said heat transfer assembly body including a second heat transfer surface;

each said heat transfer assembly body coupled to said conductive assembly with said first heat transfer surface coupled to a number of second heat transfer surfaces; and said second electrode assembly includes:

a conductive assembly including a stem portion and a contact portion;

a heat transfer assembly including a number of elongated bodies, a first heat transfer surface, and a second heat transfer surface;

said first heat transfer surface disposed on said conductive assembly; each said heat transfer assembly body including a second heat transfer surface; and each said heat transfer assembly body coupled to said conductive assembly with said first heat transfer surface coupled to a number of second heat transfer surfaces.

16. A circuit breaker comprising:

a housing assembly;

an upper terminal, said upper terminal coupled to said housing assembly;

a lower terminal, said lower terminal coupled to said housing assembly;

an operating mechanism, said operating mechanism coupled to said housing assembly;

a vacuum interrupt assembly, said vacuum interrupt assembly coupled to said upper terminal and said lower terminal;

said vacuum chamber including:

a sidewall and a bellows;

said vacuum chamber sidewall defining an enclosed space and including a first opening and a second opening;

a bellows including a body with a first end and a second end;

said bellows body first end sealingly coupled to said vacuum chamber sidewall about said second opening;

a stationary, first electrode assembly including a stem portion and a contact portion;

said first electrode assembly stem portion sealingly coupled to said vacuum chamber sidewall at said sidewall first opening;

a movable, second electrode assembly including a stem portion and a contact portion;

said second electrode assembly stem portion sealingly coupled to said bellows second end;

at least one of said first and second electrode assemblies including:

a conductive assembly including a stem portion and a contact portion;

a heat transfer assembly including a number of elongated bodies, a first heat transfer surface, and a second heat transfer surface;

said first heat transfer surface disposed on said conductive assembly;

said second heat transfer surface disposed on a number of said heat transfer assembly bodies;

each said heat transfer assembly body coupled to said conductive assembly with said first heat transfer surface coupled to said second heat transfer surfaces;

each said heat transfer assembly body including a stem portion and a contact portion;

wherein each said heat transfer assembly body contact portion has a generally circular cross-section;

said conductive assembly defines a generally circular heat transfer passage;

each said heat transfer assembly body contact portion corresponding to said heat transfer passage;

wherein said first heat transfer surface is disposed substantially over the surface of said heat transfer passage; and wherein said second heat transfer surface is disposed over the surface of each said heat transfer assembly body contact portion.

* * * * *